US009739116B2

(12) United States Patent
Kirkpatrick

(10) Patent No.: US 9,739,116 B2
(45) Date of Patent: Aug. 22, 2017

(54) CONTROL LINE SHARING BETWEEN A LOWER AND AN INSERT SAFETY VALVE

(71) Applicant: BAKER HUGHES INCORPORATED, Houston, TX (US)

(72) Inventor: Charles T. Kirkpatrick, New Caney, TX (US)

(73) Assignee: Baker Hughes Incorporated, Houston, TX (US)

( * ) Notice: Subject to any disclaimer, the term of this patent is extended or adjusted under 35 U.S.C. 154(b) by 435 days.

(21) Appl. No.: 14/298,094

(22) Filed: Jun. 6, 2014

(65) Prior Publication Data

US 2015/0354316 A1 Dec. 10, 2015

(51) Int. Cl.
*E21B 34/00* (2006.01)
*E21B 34/10* (2006.01)

(52) U.S. Cl.
CPC ..... *E21B 34/10* (2013.01); *E21B 34/00* (2013.01); *E21B 34/106* (2013.01); *E21B 2034/005* (2013.01)

(58) Field of Classification Search
CPC .. E21B 34/10; E21B 34/106; E21B 2034/005; E21B 34/00; E21B 2034/007
See application file for complete search history.

(56) References Cited

U.S. PATENT DOCUMENTS

| | | | | |
|---|---|---|---|---|
| 4,273,186 | A * | 6/1981 | Pearce | E21B 34/106 166/322 |
| 5,314,026 | A | 5/1994 | Williamson, Jr. | |
| 2009/0229834 | A1 | 9/2009 | Bolding et al. | |
| 2010/0006296 | A1 | 1/2010 | Anderson et al. | |
| 2012/0073829 | A1* | 3/2012 | Smith | E21B 34/10 166/375 |
| 2014/0034325 | A1* | 2/2014 | Jancha | E21B 34/10 166/321 |

FOREIGN PATENT DOCUMENTS

EP 2386712 A2 11/2011

* cited by examiner

*Primary Examiner* — Yong-Suk (Philip) Ro
(74) *Attorney, Agent, or Firm* — Steve Rosenblatt

(57) ABSTRACT

A system involving a lower tubing mounted safety valve having one or two control lines further contains a landing nipple above for a wireline insert valve. One line that serves the lower safety valve is tied to a connection on the landing nipple for the insert valve. When the lower safety valve malfunctions the landing nipple wall is penetrated to get communication to the line coming from the lower safety valve so that such line can serve as a balance line for the insert valve. The other line from the surface to the other connection on the landing nipple serves as the operating line for the insert valve. Making one line serve a dual purpose eliminates one control line from the surface.

18 Claims, 1 Drawing Sheet

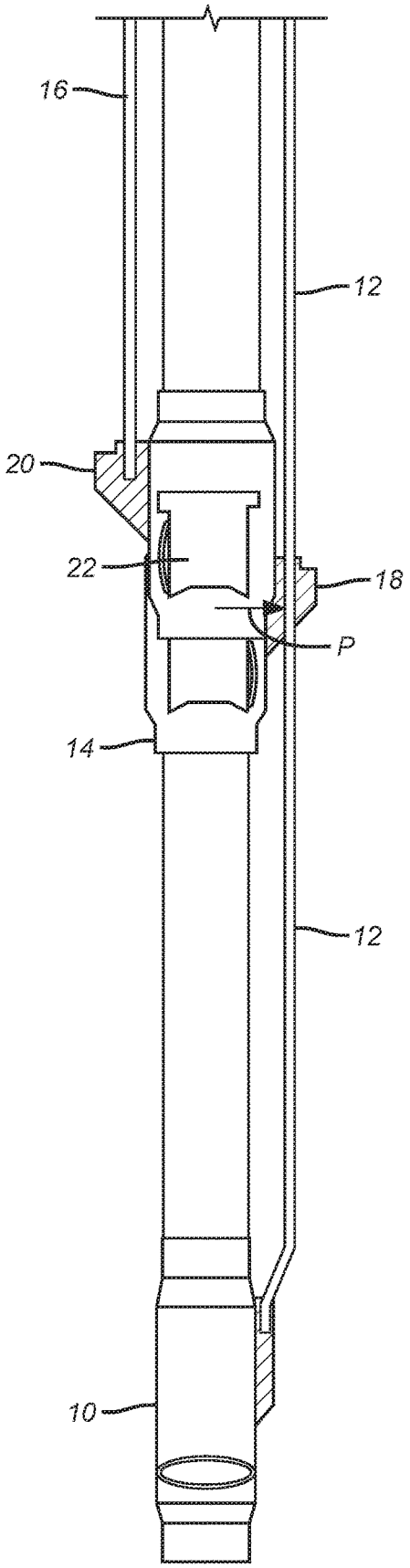
16
12
20
22
18
P
14
12
10

CONTROL LINE SHARING BETWEEN A LOWER AND AN INSERT SAFETY VALVE

FIELD OF THE INVENTION

The field of the invention is subsurface safety valves and more particularly situations where an insert safety valve is deployed above a malfunctioning lower safety valve and shares an existing control line that extends to the lower safety valve.

BACKGROUND OF THE INVENTION

Subsurface safety valves are used for emergency well control. A common design has a flow tube that is actuated by a hydraulic control system from a surface location. In a single control line system the application of pressure to the single control line has the effect of shifting the flow tube into a closure member that rotates 90 degrees to a position behind the flow tube as the flow tube advances. This closure member is known as a flapper. A closure spring is provided to act against a piston that actuates the flow tube. In SCSSVs (surface controlled subsurface safety valves) for Deepset application control line system there are in some instances a compressed gas chamber, atmospheric chamber or other components in the safety valve that acts on the piston in the same direction as the closure spring to offset the pressure from the liquid column in the control line so that the closure spring need only to act against the weight and friction forces acting on the flow tube. When the flow tube is raised by the closure spring the flapper can pivot 90 degrees to a seat and prevent flow from coming up the wellbore for control.

There is a reluctance of operators to use single line valves with pressurized gas chambers to offset control line hydrostatic because there is a risk of loss of gas pressure that could make the valve inoperative. One way around the use of pressurized gas chambers is to use dual control line safety valve control system where the hydrostatic pressure in one line is offset by the hydrostatic pressure in an adjacent line. Two line systems cost more to install and take up more space in a crowded annular volume that must be shared with umbilical assemblies that are used for power, signal, injection and other functions downhole.

In shallow set SCSSV applications a landing nipple is provided either above or integral to the safety valve so that if the original safety valve fails for any reason, what is called an insert safety valve can be landed on the nipple with a wireline after a wall opening is created with a penetration tool to provide access to the control lines that are associated with the landing nipple. There are conflicting demands when providing the option for an insert safety valve particularly in deep water applications where the regulations require the insert safety valve to be below the sea floor which can be thousands of feet below the surface water level. Such depths would normally require the use of a compressed gas chamber, atmospheric chambers or other means to offset the hydrostatic pressure if the insert valve was to run on a single control line. On the other hand if the insert valve were to run on a system with two control lines there can be space problems in view of the fact that the original control valve has at least one control line extending to it to make it a total of at least 3 control lines going to the surface.

In the present invention a way to have dual use of a control line for two different safety valves allows the line count to be reduced to two lines so that the insert valve can operate with a balance line and without a need for a pressurized gas chamber, atmospheric chambers or other means. The original safety valve would have a single control line and an opposing gas chamber atmospheric chambers or other means for the hydrostatic pressure. The single line to the original safety valve can be run into a second port on a landing nipple above so that when the second wall penetration happens in the landing nipple, the operating line for the original valve becomes the balance line for the insert valve. The first wall penetration in the landing nipple allows access to another line that terminates at another connection on the landing nipple. Thus, when the insert valve is latched into the landing nipple there are two lines connected to operate it with the balance line to the insert valve having previously served as the operating line for the original safety valve. Systems with an original valve having dual lines can still benefit from the present invention with the line count reduced to three lines total instead of what would otherwise have been four lines to make the original valve and the insert valve above it both operate without pressurized gas chambers atmospheric chambers or other means to offset control line hydrostatic. These and other aspects of the present invention will become more readily apparent from a review of the description of the preferred embodiment and the associated drawing while recognizing that the full scope of the invention is to be determined from the appended claims.

SUMMARY OF THE INVENTION

A system involving a lower tubing mounted safety valve having one or two control lines further contains a landing nipple above for a wireline insert valve. One line that serves the lower safety valve is tied to a connection on the landing nipple for the insert valve. When the lower safety valve malfunctions the landing nipple wall is penetrated to get communication to the line coming from the lower safety valve so that such line can serve as a balance line for the insert valve. The other line from the surface to the other connection on the landing nipple serves as the operating line for the insert valve. Making one line serve a dual purpose eliminates one control line from the surface.

BRIEF DESCRIPTION OF THE DRAWING

The FIGURE shows a lower safety valve and an insert valve in a landing nipple above where the operating line for the lower safety valve serves as a balance line for the insert valve above.

DETAILED DESCRIPTION OF THE PREFERRED EMBODIMENT

The FIGURE shows a lower tubing mounted safety valve 10 with a single control line 12. Mounted above the safety valve 10 is a landing nipple 14 that has a control line 16 leading from it to the surface. Control line 12 runs from the surface to safety valve 10 and passes through the hub 18 and continues to the surface.

When there is a problem with the safety valve 10 the procedure is to lock the valve 10 open in a manner known in the art so that safety valve 10 becomes a part of the tubing string in its wide open and locked position. After safety valve 10 is locked open a penetrating tool that is also known in the art is positioned opposite hubs 18 and 20. Control line 16 is isolated when the safety valve 10 is in operation. After safety valve 10 is locked open the penetrating tool that is not shown is placed in two locations in the landing nipple 14 and openings are formed to communicate into hubs 18 and 20 from the central passage where the penetrating tool, schematically illustrated by arrow P, is placed and actuated. After the penetrating tool is operated twice into hubs 18 and 20 the insert valve 22 of a type known in the art is landed and latched into the landing nipple 14. When that happens control line 16 can be used to operate the insert valve 22 and control line 12 becomes the balance line. The advantage is that the insert valve 22 has no need for a pressurized gas chamber atmospheric chambers or other means because the hydrostatic pressure in one line is offset with the hydrostatic pressure in the other line. Additionally, because line 12 is shared between safety valve 10 which is now locked open and the landing nipple 14 there are but two control lines to the surface instead of what would have been three lines in the configuration shown in the FIG. On the other hand it is also possible that the safety valve 10 could be a two line system rather than the single line system that is shown. In that instance line 16 can be made to extend to the safety valve 10 by way of hub 20 and there are still two lines to the surface rather than the four that would be needed to equip two standalone safety valves for independent operation. The space saving from running less lines makes room for other lines or just a smaller umbilical cable. Thus depending on the design of the lower safety valve 10 there is the potential of saving one or two control lines in the borehole and providing an insert safety valve with a balance line so that compressed gas chambers to offset hydrostatic are not needed. This allows use of an insert valve that has a lower pressure rating and a more reliable reputation for operation that is desired by the well operator.

The above description is illustrative of the preferred embodiment and many modifications may be made by those skilled in the art without departing from the invention whose scope is to be determined from the literal and equivalent scope of the claims below:

I claim:

1. A subterranean safety valve system for a borehole, comprising:

a tubing string mounted safety valve operable in the borehole by at least one control line;

an insert safety valve selectively mounted to a landing nipple on the tubing string;

said at least one control line extending from said tubing string mounted safety valve to said landing nipple and continuing uphole along said tubing string such that said at least one control line is initially isolated from fluid communication with said insert valve and thereafter communication from said at least one control line through said landing nipple is established for operation of said insert valve in place of said tubing string mounted safety valve with said tubing string mounted safety valve held in an open position.

2. A subterranean safety valve system for a borehole, comprising:

a tubing string mounted safety valve operable in the borehole by at least one control line;

an insert safety valve selectively mounted to a landing nipple on the tubing string;

said at least one control line extending from said tubing string safety valve to said landing nipple and continuing uphole along said tubing string such that said at least one control line selectively is in fluid communication with said insert valve for operation of said insert valve in place of said tubing string mounted safety valve;

said at least one control line comprises a first and second control lines;

said first control line in selective fluid communication with said landing nipple and continuing to said tubing string mounted safety valve and said second control line extending along said tubing string to said landing nipple.

3. The system of claim 2, wherein:

said second control line transmits pressure that operates said insert safety valve and said first control line offsets hydrostatic pressure that is in said second control line.

4. The system of claim 2, wherein:

said second control line terminates at said landing nipple.

5. The system of claim 2, wherein:

said second control line extends beyond said landing nipple to said tubing string mounted safety valve.

6. The system of claim 5, wherein:

said second control line selectively delivers operating pressure to said tubing string mounted safety valve and then to said insert valve as said tubing string mounted safety valve is out of service, while said first control line balances hydrostatic pressure in said second control line independently of whether said tubing string mounted safety valve or said insert valve are in service.

7. The system of claim 2, wherein:

said first and second control lines extend into discrete hubs on said landing nipple.

8. The system of claim 7, wherein:

said hubs initially isolated from a passage in said landing nipple by a wall.

9. The system of claim 8, wherein:

said wall is selectively penetrated for access to said first and second control lines through said hubs.

10. A method for providing a backup safety valve to a safety valve, comprising:

running a tubing string with said safety valve to a subterranean location;

providing a landing nipple on said string ahead of said safety valve;

selectively using a control line to extend in initial fluid communication only to said safety valve and selectively thereafter to said landing nipple;

pressurizing said control line in operation of both said safety valve and said backup safety valve landed in said landing nipple.

11. The method of claim 10, comprising:

running fewer control lines to a surface location because of said first control line extending in selective fluid communication to both said safety valve and said landing nipple.

12. A method for providing a backup safety valve to a safety valve, comprising:

running a tubing string with said safety valve to a subterranean location;

providing a landing nipple on said string ahead of said safety valve;

selectively using a first control line to extend in selective fluid communication to said safety valve and said landing nipple;

selectively using said first control line in operation of both said safety valve and an insert safety valve landed in said landing nipple;

providing a second control line to extend at least to said landing nipple.

13. The method of claim 12, comprising:

using said first control line as a balance line for said second control line at said landing nipple.

14. The method of claim 13, comprising:

omitting a charged fluid chamber for hydrostatic pressure offset in said insert safety valve due to the presence of said first control line to offset hydrostatic pressure in said second control line.

15. The method of claim 14, comprising:

extending said second control line to said safety valve.

16. The method of claim 12, comprising:

initially operating said safety valve with said first control line;

locking open said safety valve after said safety valve malfunctions;

providing a second control line to said landing nipple;

initially operating said insert safety valve in said landing nipple with said second control line while offsetting hydrostatic in said second control line with said first control line at said landing nipple.

17. The method of claim 16, comprising:

obtaining pressure communication to said first and second control lines by penetrating a wall in said landing nipple at two locations.

18. The method of claim 16, comprising:

extending said second control line past said landing nipple and to said safety valve;

initially operating said safety valve with said second control line and using said first control line for offsetting hydrostatic pressure in said first control line at said safety valve;

taking said safety valve out of service by locking said safety valve open;

opening access from a passage in said landing nipple to said first and second control lines for operation of the insert valve landed in said landing nipple with hydrostatic pressure balance between said first and second control lines.

* * * * *